US005778144A

United States Patent [19]

McDougall

[11] Patent Number: 5,778,144

[45] Date of Patent: Jul. 7, 1998

[54] ELECTRIC FAN HEATER

[76] Inventor: Greg McDougall, 5-C, Taichi Court, 132 Austin Road, Tsim Sha Tsui, Kowloon, Hong Kong

[21] Appl. No.: 748,004

[22] Filed: Nov. 12, 1996

Related U.S. Application Data

[63] Continuation of Ser. No. 341,513, Nov. 17, 1994.

[51] Int. Cl.[6] ..... A45D 20/10

[52] U.S. Cl. ..... 392/385; 392/379; 392/383

[58] Field of Search ..... 392/360–370, 392/373, 375–385; 34/96–101; 132/112, 116, 118

[56] References Cited

U.S. PATENT DOCUMENTS

| | | | |
|---|---|---|---|
| 1,829,303 | 10/1931 | Schaber | 392/376 |
| 2,016,096 | 10/1935 | Martin . | |
| 2,240,653 | 5/1941 | Jenkins et al. . | |
| 3,077,531 | 2/1963 | Wompey | 392/376 |
| 3,818,600 | 6/1974 | Fischer | 34/99 |
| 3,831,000 | 8/1974 | Waters et al. | 392/383 |
| 3,877,153 | 4/1975 | Keimpema | 34/99 |
| 3,955,065 | 5/1976 | Chambon . | |
| 4,039,774 | 8/1977 | Kata et al. . | |
| 4,146,776 | 3/1979 | Johansen . | |
| 4,744,154 | 5/1988 | Bollinger et al. | 34/283 |
| 4,766,914 | 8/1988 | Briggs . | |
| 5,133,043 | 7/1992 | Baugh | 392/383 |
| 5,526,578 | 6/1996 | Iyer | 34/97 |

FOREIGN PATENT DOCUMENTS

| | | | |
|---|---|---|---|
| 2728406 | 1/1979 | Germany | 34/96 |
| 2804862 | 8/1979 | Germany . | |
| 2932127 | 2/1981 | Germany | 392/383 |
| 3220574A1 | 12/1983 | Germany . | |
| 419597 | 11/1934 | United Kingdom . | |
| 650511 | 2/1951 | United Kingdom . | |
| 924139 | 4/1963 | United Kingdom . | |
| 1345674 | 1/1974 | United Kingdom . | |
| 1348683 | 3/1974 | United Kingdom . | |
| 1471686 | 4/1977 | United Kingdom . | |
| 2125954 | 6/1984 | United Kingdom . | |

*Primary Examiner*—Tu B. Hoang
*Attorney, Agent, or Firm*—Gunn, Lee & Miller, PC

[57] ABSTRACT

An electric hair drier comprises a shallow housing 10 having an apertured boss 11 formed on its base. An electric motor 12 drives a thin cup shaped impeller 15 which in use draws air in through apertures 14 in the boss 11 and blows air radially towards a heating coil 17 surrounding inside peripheral surface 25 of the impeller 15. The impeller has external blades 26 which in use draw air from the inside peripheral surface 25 towards a central axis of the drier at the mouth of the drier. The drier has an array of comb members 20 at its mouth. The thinness of the impeller 15 and the inherent even distribution of air passing over the coil 17 provides a hair drier which can be much thinner overall, and hence more comfortable to use, and in which the air is effectively and evenly heated.

6 Claims, 3 Drawing Sheets

ELECTRIC FAN HEATER

"This is a continuation of copending application Ser. No. 08/341,513 filed on Nov. 17, 1994."

BACKGROUND OF THE INVENTION

The invention relates to an electric fan heater.

The invention has particular although not exclusive application to hair driers. Fan heaters and especially hair driers are generally inherently longer or deeper than is preferred and incorporate electrical heating coils over which the air is blown by a fan and out of a nozzle. At present not only are fan heaters somewhat cumbersome because of their size or restricted shape but also circulation of air around the coils is often un-even or inefficient leading to "hot spots " forming at places on the wires of the coils. Also significant variations in the temperature are experienced across an area of the nozzle. The last problem can be particularly detrimental in hair drier applications.

It is an object of the invention to overcome or at least reduce these problems.

SUMMARY OF THE INVENTION

According to the invention there is provided an electric fan heater comprising a shallow housing having a central longitudinal axis and an apertured base, a cup shaped air impeller mounted to rotate within the housing about the axis with internal blades extending part way towards the periphery of the cup and arranged to draw air through the apertures of the base and blow the air radially towards the inside peripheral surface of the cup and out of the mouth of the housing, and electrical heating coils surrounding the ends of the blades to heat the air before it is blown out of the housing.

The impeller preferably has external blades on one side remote from the apertures arranged in use to draw air away from the peripheral surface towards the axis of the housing.

An electric motor may be connected to the impeller by a shaft mounted to the base of the housing. The base of the housing may be formed with a central boss extending away from the impeller and the apertures are formed in the sides of the boss.

A circular array of resilient comb members may be mounted to and extend forward of the mouth of the cup.

The heater may have an overall size and shape to fit comfortably in a palm of a hand of a user.

An electrical hair drier according to the invention will now be described by way of example with reference to the accompanying diagrammatic drawings in which:

DESCRIPTION OF THE PREFERRED EMBODIMENT

Figure 1:
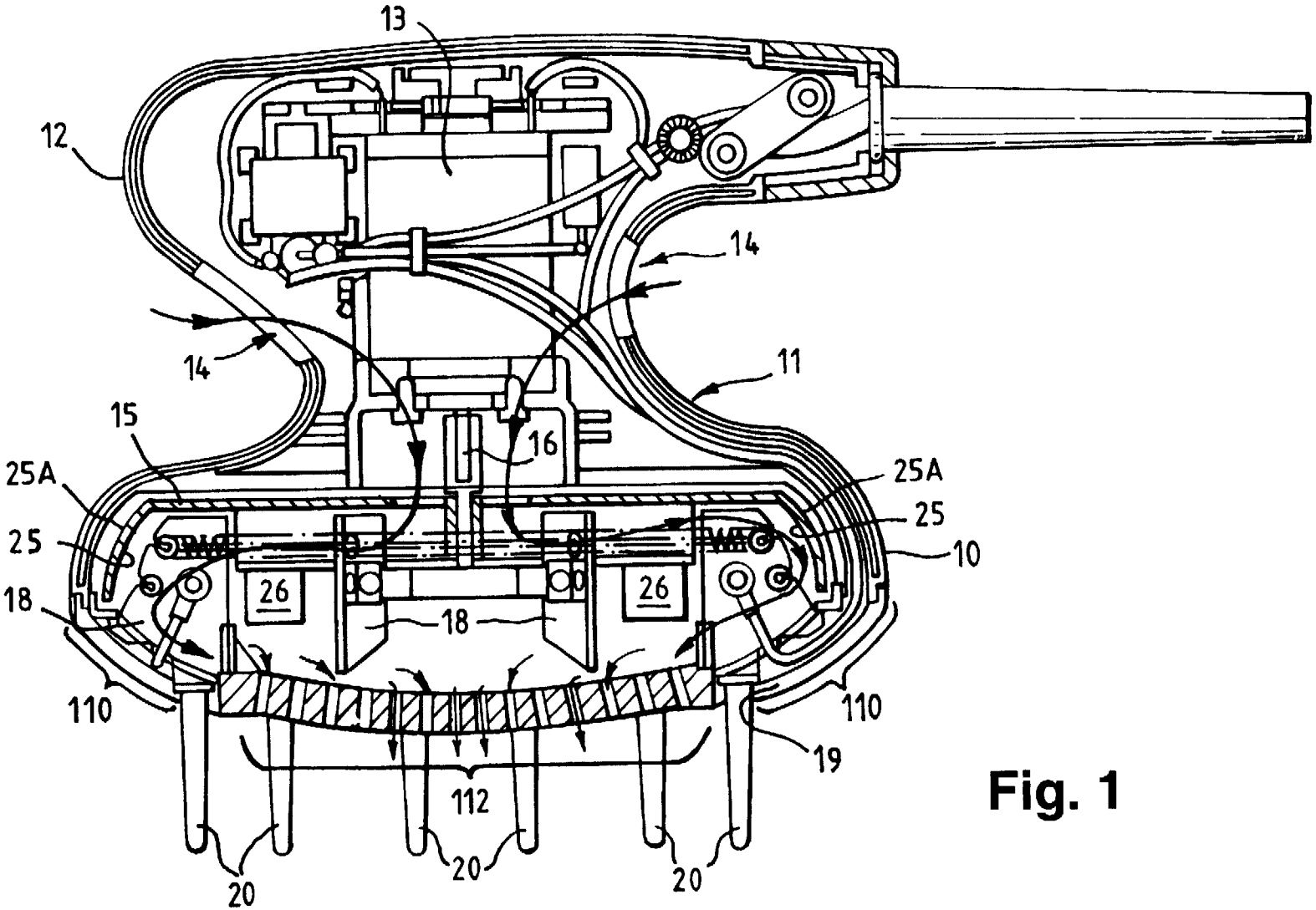
FIG. 1 is an exposed sectional side elevation of the drier.
Figure 4:
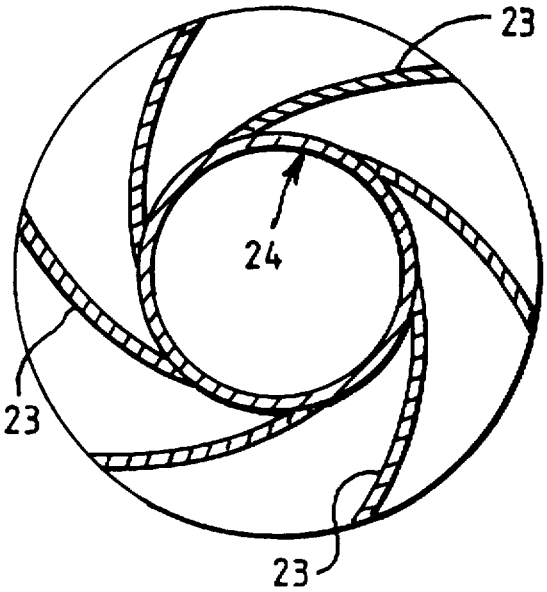
FIG. 4 is a view along line 4—4 of FIG. 3.
Figure 5:
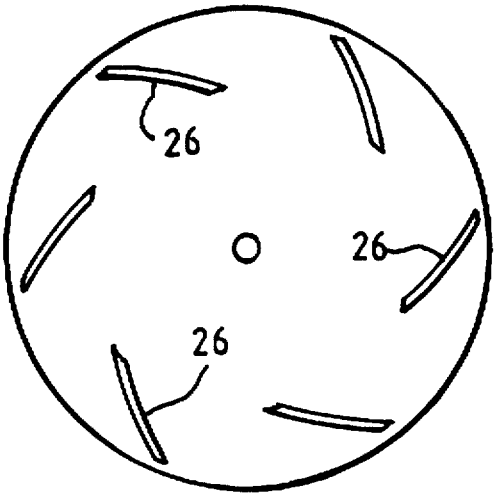
FIG. 5 is a view along line 5—5 of FIG. 3.
Figure 6:
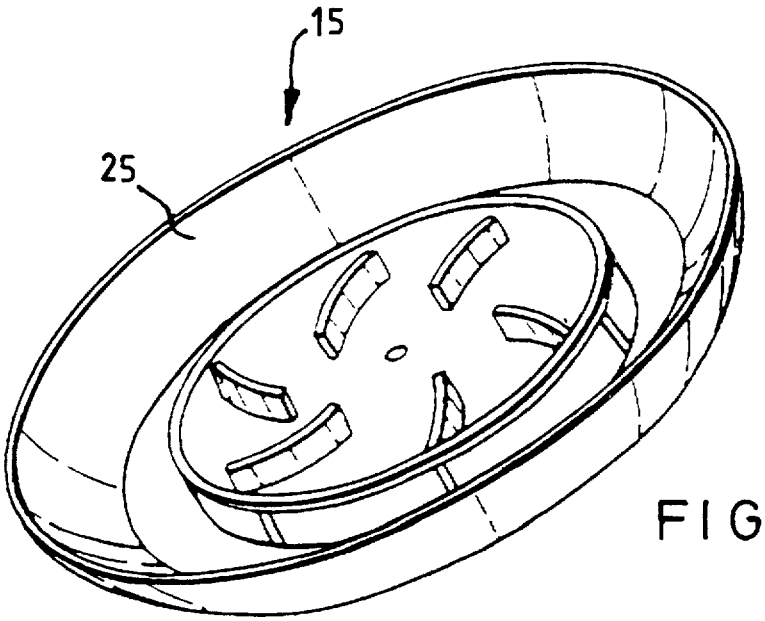
FIG. 6 is a top isometric view of the air impeller.

Referring to the drawings, in FIG. 1, the drier has a shallow front housing 10 formed with a central boss 11 on its base extending to a rear housing 12. An electric motor 13 is mounted inside the rear housing 12. A number of apertures 14 are distributed around the side of the boss 11. A generally flat cup-shaped air impeller 15 (shown in FIGS. 4 to 6) is supported on a shaft 16 for rotation about a central longitudinal axis of the housings 10 and 12. In use, the impeller 15 draws air in through the apertures 14 and blows air radially towards a peripheral inside surface of the cup, and over an electric heating coil 17 mounted therein. The coil 17 is supported on frame members 18 adjacent the peripheral inside surface.

Figure 2:
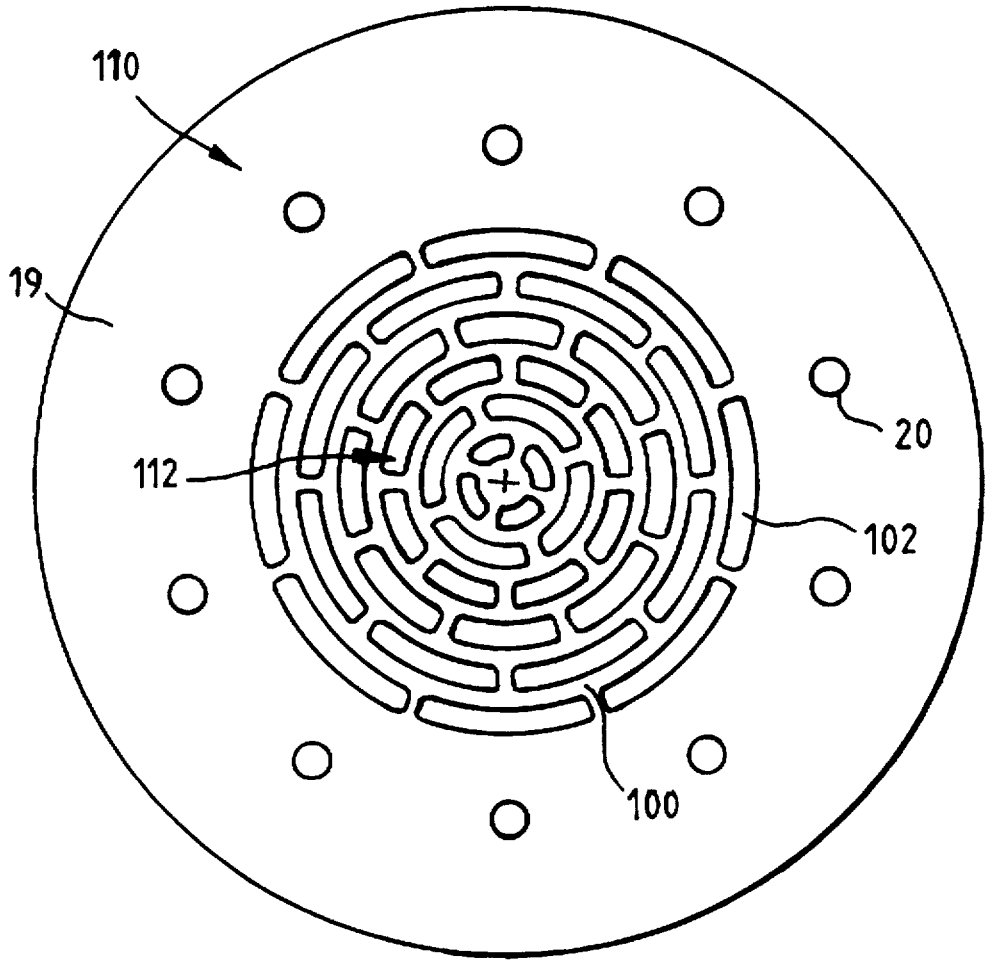
FIG. 2 is a front view of the mouth of the drier showing the aperture and comb arrangement.

A mouth 100 of the drier is formed by a separate circular member 19 which serves to somewhat close off the mouth and is formed with apertures 102 (see FIG. 2). An array of resilient comb members 20 are mounted on the member 19 and extend forward of the mouth of the drier.

Figure 3:
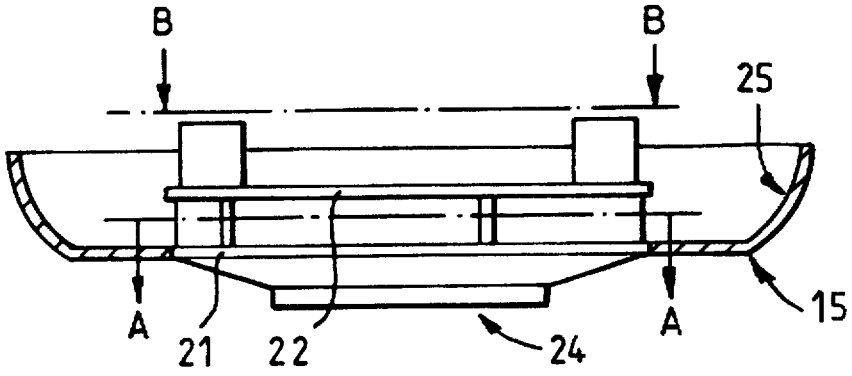
FIG. 3 is a sectional side view of an air impeller for the drier.

The impeller 15 (see FIGS. 4 to 6) is formed with two circular side plates 21 and 22 and a number of curved baffles 23 extend between them. The baffles extend generally radially from adjacent the outer edge of the plate 22 towards the center. The plate 22 has a central aperture 24 to allow air to enter around the center of the impeller and be urged radially outwards towards the peripheral inside surface 25 of a curved part or addition 25A to the plate 22. Overall the impeller forms a flat cup-shaped configuration as shown best in FIG. 3 or 6. The impeller 15 has a number of external blades 26 on one side remote from the aperture 24 which in use direct air from the peripheral inside surface 25 towards the central axis of the device and out of the mouth.

As the impeller 15 can be generally narrow, the overall longitudinal length of the drier is significantly less than present hair driers of similar capacity, and so can be comfortably held in the palm of a hand of the user, for example. In the described configuration, air tends to swirl completely around the heating coil 17 so that transfer of heat from the coil 17 to the air is particularly effective. Also, as the air is distributed and positively directed continuously by the impeller 15 over the whole length of the coil 17 in use, there is no inherent tendency or practical likelihood of any hot spots forming on the coil. Further, as the air is evenly distributed by the impeller 15, air flowing out of the mouth of the drier in use not only flows generally parallel to the longitudinal axis 16 but the air temperature is consistent across the whole area of the mouth. This means that between the array of comb members 20 at any time during use, the exiting air is consistent both in speed of flow and in temperature.

The motor 13 may be arranged to be run at two or more different speeds. The described arrangement is suitable for comb drying both long hair and short hair and also as a diffuser for setting hair. As the drier can be inherently small and light weight holding the drier some distance away from the hair is much less of a strain than when using currently available diffusers. The drier also delivers in its described form a fine soft or gentle air flow and so can be used as a diffuser without the need for fitting a diffuser attachment.

Whereas the described electric heater is in the form of a hair drier, embodiments of the invention may be provided in the form of domestic space heaters for example. The described construction, especially using a thin air impeller as illustrated particularly in FIGS. 3 to 6 and surrounding the impeller with one or more heating coils, enables the space heater or other heaters also to be relatively thin or short overall. In the same way as described, the air is efficiently heated because the air is positively and evenly blown against and around the heating coils. Thus, in practice the air tends to swirl around the heating coils before exiting out of the mouth of the housing.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

I claim:

1. An electric fan heater comprising a shallow housing having a central longitudinal axis and an apertured base, a cup shaped air impeller mounted to rotate within said housing about said axis with internal blades extending part way towards a periphery of said cup and arranged to draw air through apertures of said base and blow air radially towards an inside peripheral surf ace of said cup and out of a mouth of said housing, a separate circular member having a central region forming said mouth and a peripheral region extending outwards from said central axis between said central region to opposite said periphery of said cup to direct air from said impeller inwards towards said mouth, and electrical heating coils surrounding ends of said blades mounted adjacent and surrounded by said inside peripheral surface to heat said air before it is blown out of said housing.

2. A heater according to claim 1, in which said impeller has external blades on one side remote from said apertures of said base arranged in use to draw air away from said inside peripheral surface towards said central axis of said housing.

3. A heater according to claim 1, including an electric motor connected to said impeller by a shaft mounted to said base of said housing.

4. A heater according to claim 1, in which said base of said housing is formed with a central boss extending away from said impeller and said apertures of said base are formed in said sides of said boss.

5. A heater according to claim 1, having a circular array of resilient comb members mounted to and extending forward of said mouth of said cup.

6. An electric fan hair drier comprising a shallow housing having a central longitudinal axis and an apertured base, a cup shaped air impeller mounted to rotate within said housing about said axis with internal blades extending part way towards a periphery of said cup and arranged to draw air through apertures of said base and blow air radially towards an inside peripheral surface of said cup and out of a mouth of said housing, a separate circular member having a central region forming said mouth and a peripheral region extending outwards from said central axis between said central region to opposite said periphery of said cup to direct air from said impeller inwards towards said mouth, and electrical heating coils surrounding ends of said blades mounted adjacent and surrounded by said inside peripheral surface to heat said air before it is blown out of said housing.

* * * * *